United States Patent [19]

Stevens et al.

[11] Patent Number: 4,457,453

[45] Date of Patent: Jul. 3, 1984

[54] SELF-SEALING CONTAINER CLOSURE

[76] Inventors: Peter P. Stevens, Rte. 1, P.O. Box 56, Cochise, Ariz. 85606; Thomas R. McClure, 5954 Balboa Dr., Oakland, Calif. 94611; Ann H. Firstenfeld, 44 Estrada La., Corte Madera, Calif. 94925

[21] Appl. No.: 436,087

[22] Filed: Oct. 22, 1982

[51] Int. Cl.[3] ..... B65D 37/00

[52] U.S. Cl. ..... 222/48; 222/213; 222/341; 222/509; 222/518

[58] Field of Search ..... 222/213, 509, 518, 559, 222/336, 406, 407, 340, 341, 212, 47, 48

[56] References Cited

U.S. PATENT DOCUMENTS

| | | | |
|---|---|---|---|
| 300,450 | 6/1884 | Doremus | 222/213 |
| 936,186 | 10/1909 | Tellerson | 222/213 |
| 2,596,592 | 7/1950 | Parker | 222/213 |
| 3,087,656 | 3/1961 | Dougherty | 222/213 |
| 3,107,035 | 8/1960 | Cholet | 222/213 |
| 3,141,580 | 12/1963 | Rogers | 222/213 |
| 3,154,222 | 10/1964 | Heckman | 222/213 |
| 3,244,332 | 11/1964 | Rogers | 222/213 |
| 3,356,267 | 10/1966 | Scholle | 222/213 |
| 3,542,257 | 11/1970 | Parish | 222/509 |

FOREIGN PATENT DOCUMENTS

| | | | |
|---|---|---|---|
| 595557 | 7/1959 | Italy | 222/213 |

*Primary Examiner*—Joseph J. Rolla
*Assistant Examiner*—Kevin P. Shaver
*Attorney, Agent, or Firm*—Townsend and Townsend

[57] ABSTRACT

A self-sealing container closure includes a rotatable cap mounted over the mouth of an oval squeezable container. The cap has an outlet opening defined by a valve seat. The outlet opening is sealed by a valve element forced against the valve seat by a valve spring and a pair of actuating arms. An upper end of each actuating arm is non-rotatably coupled to the cap while the lower end is connected to the valve spring. When the cap is rotated to align the actuating arms with the minimum width of the container, squeezing the sides of the container presses on the actuating arms to further deflect the valve spring. This forces the valve element away from the valve seat to open the container. Rotating the cap, to align the arms with the maximum width of the container, places the container in a non-operational mode. Also disclosed is a piston and cylinder arrangement coupled to the actuating arms for dispensing a measured amount of liquid from the container.

20 Claims, 8 Drawing Figures

SELF-SEALING CONTAINER CLOSURE

BACKGROUND OF THE INVENTION

This invention is related to self-sealing container closures of the type actuated by pressing on the sides of a the container to withdraw a valve element from the outlet opening on the cap.

Self-sealing caps of various types are well known. One type uses a valve element spring-biased against a valve seat in the cap to seal the outlet. The valve assembly on such containers is constructed so that squeezing the side of the container, or sometimes the cap, deflects the valve spring to unseat the valve element. These types of valve assemblies permit one-handed operation and eliminate the need for manually resealing the container. However, the prior art self-sealing container closures suffer from a common problem. Unintended pressure on the sides of the container, or cap, can also unseat the valve element to inadvertently open the container. Thus these prior art container closures are prone to inadvertently open whenever appropriate force is applied. They are thus totally unsuitable for use in some environments, such as packed in a suitcase, and undesirable for use in many others, such as for shipment of liquids to retailers for resale to consumers.

SUMMARY OF THE INVENTION

The invention is a self-sealing container closure and includes a non-threaded, rotatable cap mounted over the mouth of a squeezable container having an other-than-round cross-sectional shape. The width of the container in one direction (the maximum width) is much larger than its width in another direction (the minimum width). The cap has an outlet opening defining a valve seat. A valve element is forced against the valve seat from the interior of the bottle by a valve spring assembly through an axial valve stem.

The valve spring assembly includes a valve spring and a pair of actuating arms. An upper end of each actuating arm is non-rotatably coupled to the cap while the lower end is connected to the valve spring. The actuating arms extend longitudinally into the squeezable container and are spaced-apart from and on opposite sides of the valve stem.

The cap can be rotated to align the actuating arms with the minimum width of the container, the operational mode. When so aligned squeezing the sides of the container forces the container wall against the actuating arms to unseat the valve element from the valve seat. Releasing the container allows the valve spring to seat the valve element to seal the container. Rotating the cap 90°, which also rotates the actuating arms 90°, aligns the arms with the maximum width of the bottle, the non-operational mode. In that position squeezing on the sides of the bottle has no affect on the actuating arms so that the bottle remains sealed.

A resilient ring can be mounted to the ends of the valve spring. When such a ring is used, squeezing on the bottle in the non-operational mode deflects the ring to increase the sealing force between the valve element and the valve seat. This enhances the effectiveness of the seal.

A primary feature of the invention is the coupling of the actuating arms of the valve assembly for rotation with the cap. When the actuating arms are aligned with the minimum width of the squeezable container the valve assembly is operational; when the actuating arms are aligned with the maximum width of the container the valve assembly is non-operational.

Another feature of the invention is the use of a cylinder and piston arrangement for dispensing a measured amount of liquid from the container with each squeeze. This is accomplished by configuring the cap and valve coupling means to form a cylinder within the cap. The piston is mounted about the valve stem and is normally biased away from the outlet by a piston spring coupled to the piston by a tubular stem. The piston spring is also connected to the actuating arms so that when the actuating arms are deflected inwardly, to withdraw the valve element from the valve seat, the piston is driven towards the valve seat. The volume of liquid ejected from the container will be about equal to the volume swept by the piston within the cylinder.

Other features and advantages of the present invention will appear from the following description in which the preferred embodiments have been set forth in detail in conjunction with the accompanying drawings.

DETAILED DESCRIPTION OF THE PREFERRED EMBODIMENTS

Figure 1:
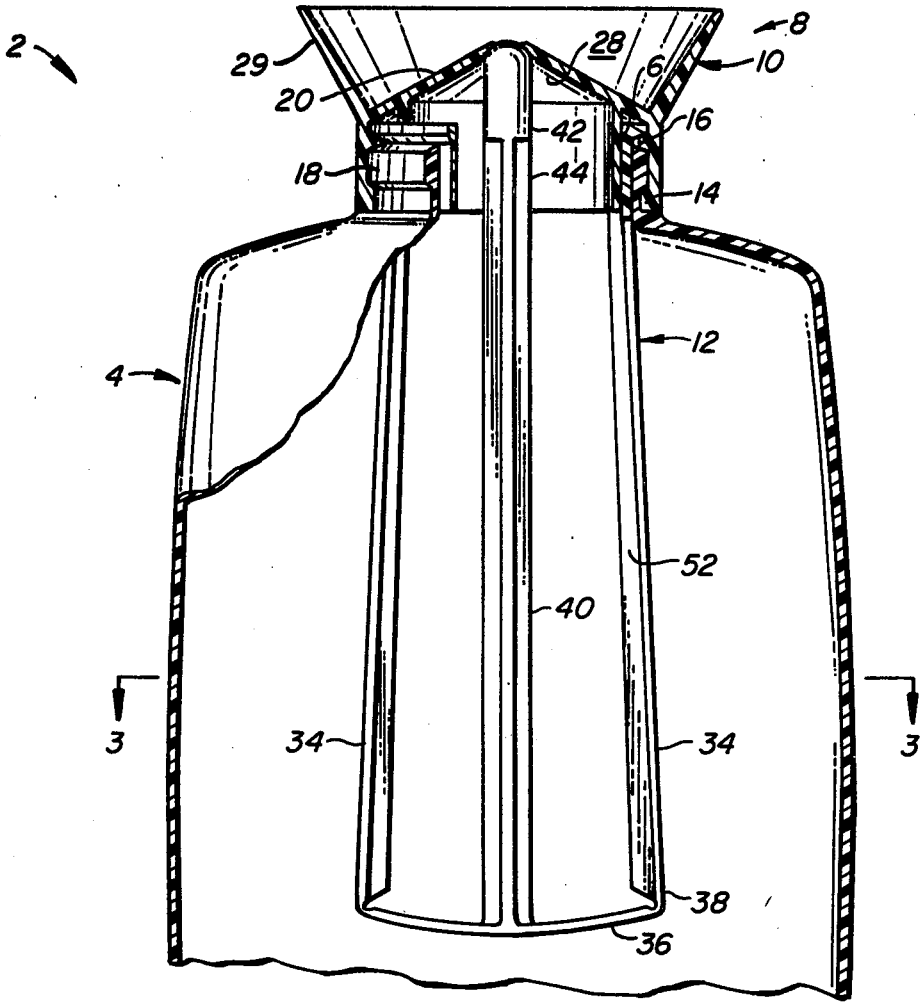
FIG. 1 is a side view of a container made according to the present invention with portions broken away for clarity of understanding.
Figure 2:
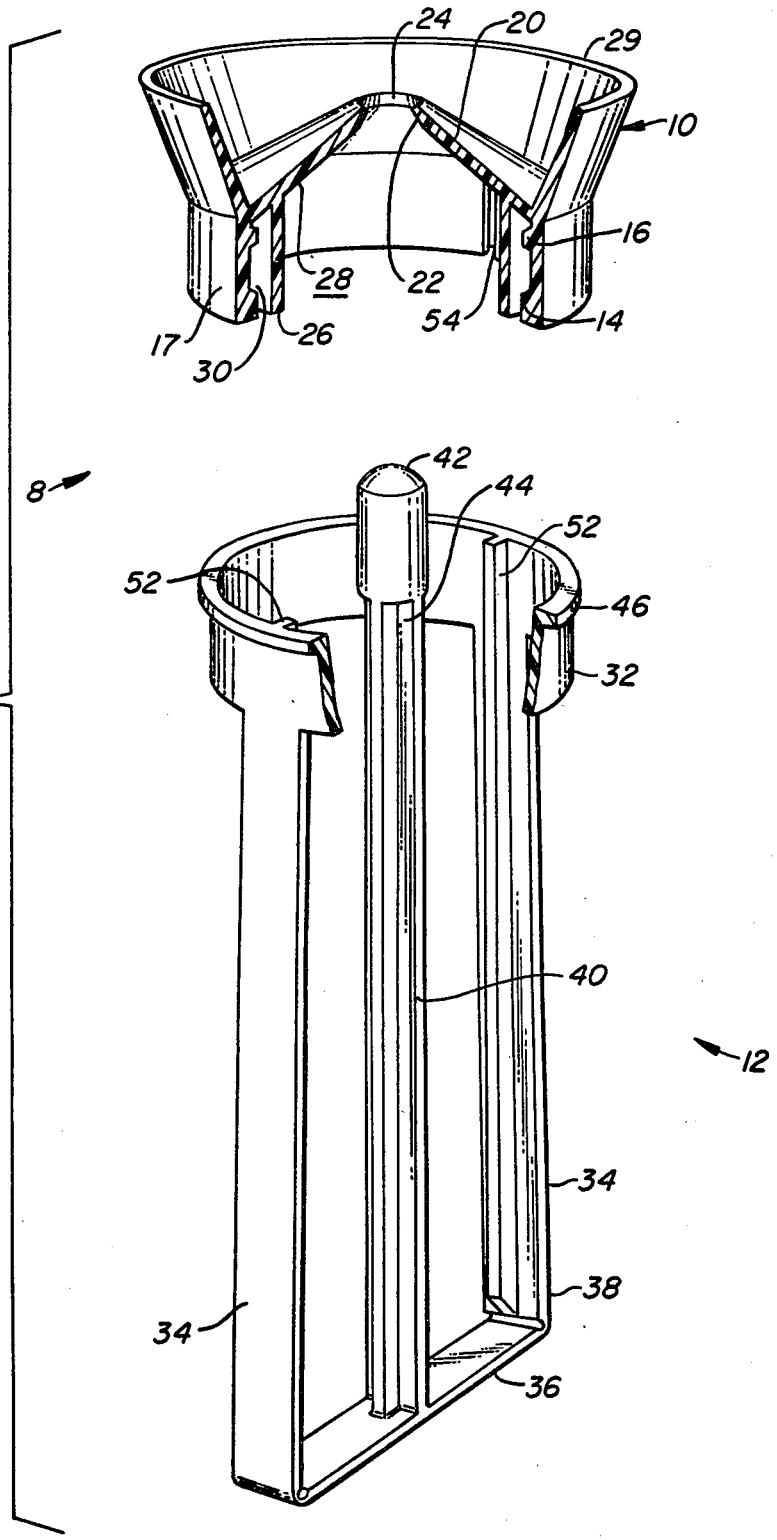
FIG. 2 is an exploded isometric view of the container closure of FIG. 1.

Turning now to FIGS. 1 and 2, container 2 includes a squeezable bottle 4 having a generally oval cross-sectional shape and a circular mouth 6 sealed by a container closure 8. Closure 8 includes broadly a cap 10 and a valve assembly 12. In this application terms such as up and down will refer to the orientation of the container as shown in the figures. These terms are used for ease of reference and are not intended to be limiting.

Cap 10 includes major and minor abutments 14, 16, extending inwardly from an outer cap ring 17, positioned to lie above and below a ring 18 surrounding mouth 6 of bottle 4. An upwardly and inwardly tapering conical covering portion 20 has a circular valve seat 22 at its center defining an outlet 24. An inner cap ring 26 extends downwardly from a lower surface 28 of tapering portion 20 and defines an annular space 30 between it and outer cap ring 17. A support rim 29 extends upwardly and outwardly from the intersection of ring 17 and portion 20. Rim 29 allows container 2 to be stored upside down relative to its orientation in the figures. This is an advantage when the liquid contained within container 2 is viscous, such as shampoo or honey, so that the user need not wait for the liquid to flow to cap 10 after inverting the container.

Valve assembly 12 includes a coupling ring 32 from which a pair of actuating arms 34 depend. A valve spring 36 couples the lower ends 38 of arms 34. An elongate axial valve stem 40 extends upwardly from a central portion of valve spring 36. A valve element 42 is connected to an upper end 44 of valve stem 40. Ring 32 is sized so that it fits snuggly within annular space 30. A flange 46, extending outwardly from the upper edge of coupling ring 32, restricts axial movement of valve assembly 12 when assembled with cap 10 and bottle 4. Axial valve stem 40 is sized so that when cap 10 and valve assembly 12 are mounted to mouth 6, valve seat 22 presses against valve element 42 thus forcing valve stem against spring 36 to deflect the spring. This ensures outlet 24 remains sealed under the bias of spring 36.

Figure 3:
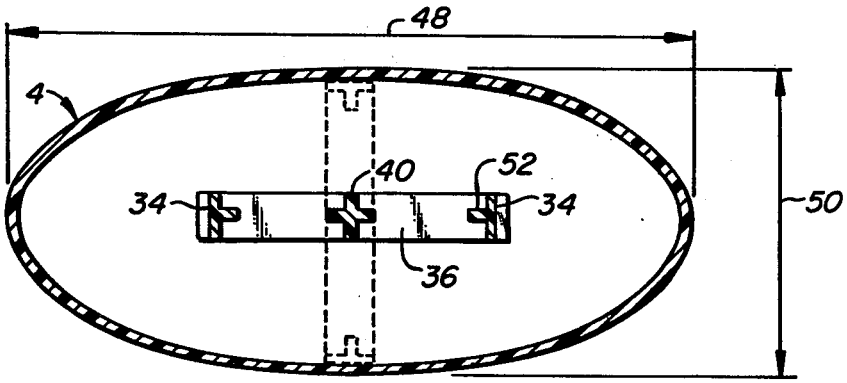
FIG. 3 is a cross-sectional view of the container of FIG. 1 taken along line 3—3.

Container closure 8 in FIGS. 1 and 3 is in its non-operational mode. That is, actuating arms 34 are generally aligned along a maximum width 48. Thus, squeezing on bottle 4 along width 48 will not usually deflect actuating arms 34 because of the relatively large distance between the actuating arms and the walls of the bottle opposite the arms. Squeezing on the bottle along its minimum width 50 will likewise not bias actuating arms 34 towards valve stem 40. Container 2 thus remains securely sealed.

Valve assembly 12 and cap 10 are coupled to allow actuating arms 34 to be aligned with either maximum or minimum widths 48, 50. In the preferred embodiment this is accomplished by engagement of ribs 52 extending from the inside surface of ring 32 with complementary slots 54 formed in inner cap ring 26.

Figure 4:
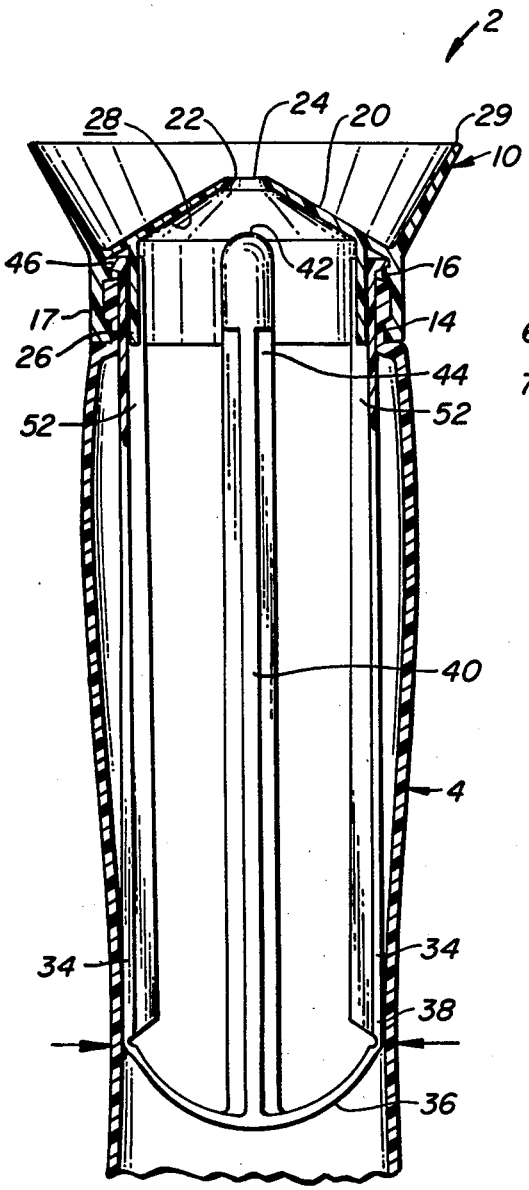
FIG. 4 is a cross-sectional view of the container of FIG. 1 showing the container closure in the operational mode and the sides of the bottle depressed to open the outlet.

FIG. 4 shows container 2 with cap 10, and thus actuating arms 34, rotated 90° from the position of FIG. 1. This operational mode is indicated in FIG. 3 by showing spring 36 and arms 34 in dashed lines. By squeezing on bottle 4 along minimum width 50, the sides of bottle 4 force arms 34 toward stem 40 to further deflect valve spring 36. This action lowers valve stem 40 and valve element 42 thus opening outlet 24. Release of bottle 4 allows spring 36 to straighten thus forcing valve element 42 against valve seat 22 to seal outlet 24. Conical lower surface 28 guides valve element 42 into valve seat 22 for accurate seating.

Figure 7:
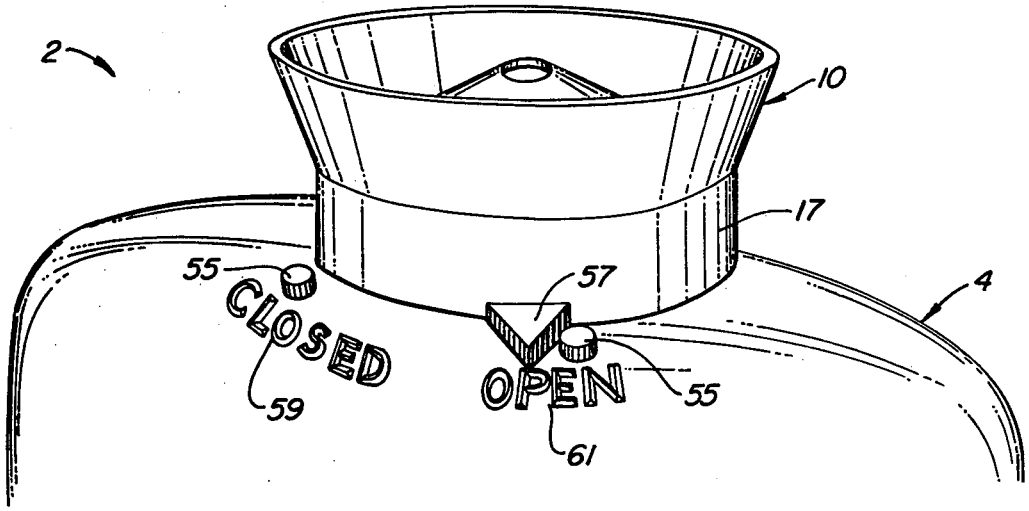
FIG. 7 is a perspective view of the upper portion of the container of FIG. 1 illustrating the stops which limit the rotation of the cap.

Bottle 4, as shown in FIG. 7, includes a pair of outwardly extending stops 55 which limit the rotary movement of cap 10 and closure 8. Stops 55 are positioned adjacent the lower edge of ring 17 to contact a pointer 57 when cap 10 is rotated. Stops 55 are positioned about 90° apart to limit the rotation of closure 8 between the non-operational mode of FIGS. 1 and 3 and the operational mode of FIG. 4. Appropriate markings 59, 61 are formed on bottle 4 to indicate when the container is closed and open.

Figure 5:
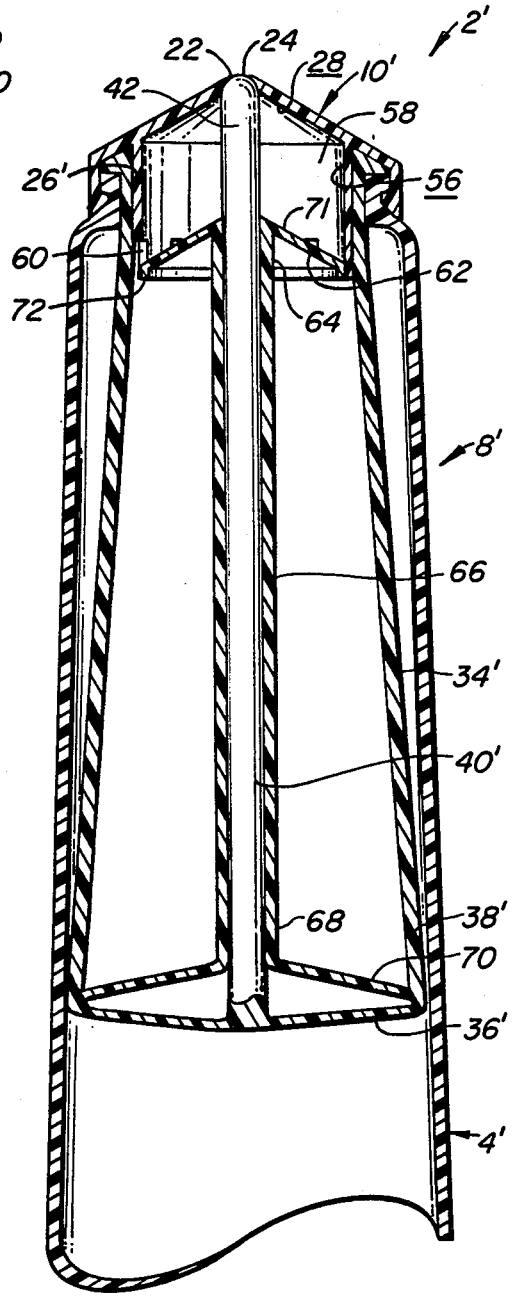
FIG. 5 is a cross-sectional view of a first alternative embodiment of the container of FIG. 1 incorporating a piston and cylinder for dispensing a measured amount of liquid.
Figure 6:
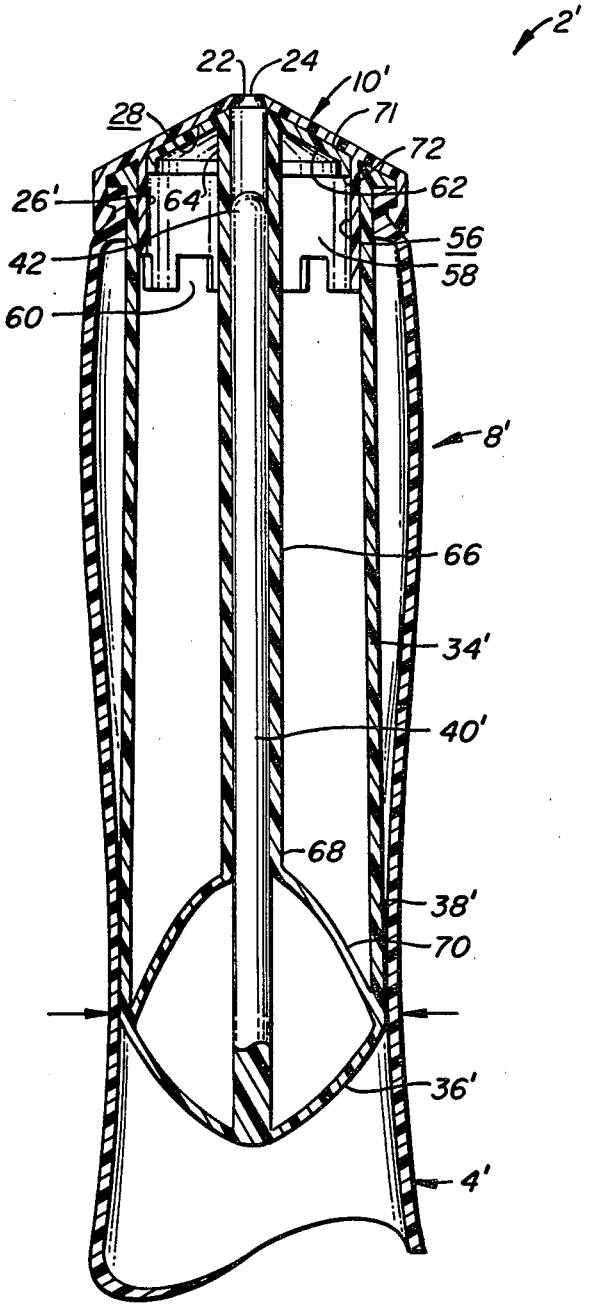
FIG. 6 shows the container of FIG. 5 with the actuating arms deflected and the piston in its fully extended position.

Turning now to FIGS. 5 and 6, a first alternative embodiment of the invention is disclosed. Container closure 8′ is modified to include structure for dispensing measured amounts of liquid on each squeeze. Container 2′ is generally similar to container 2 described above with the following primary distinctions.

Lower surface 28 of cap 10′ and the inner surface 56 of inner cap ring 26′ define a cylinder 58. The lower portion of cylinder 58 includes a number of ports 60 which allow liquid to enter within cylinder 58 when container closure 8′ is in its relaxed, substantially unbiased state shown in FIG. 5. A piston 62 is mounted over a cylindrical valve stem 40′ for movement along cylinder 58. Piston 62 is connected to the upper end 64 of a tubular stem 66. The lower end 68 of stem 66 is connected to a piston spring 70. Spring 70 includes a central opening for passage of valve stem 40′. Both valve spring 36′ and piston spring 70 are connected at their ends to the lower ends 38′ of actuating arms 34′.

Squeezing bottle 4′ along its minimum dimension, shown in FIG. 6, forces valve element 42 down away from valve seat 22 to open outlet 24 similar to the manner of operation of the above-described embodiment. Simultaneously piston spring 70 forces tubular stem 66, and thus piston 62, upwardly through cylinder 58 until the upper face 71 of piston 62 contacts surface 28. After the lower edge 72 of piston 62 passes ports 60 substantially all of the liquid within cylinder 58 is forced out of outlet 24 by the sweeping action of piston 62. Release of the sides of the bottle allows piston 62 to be retracted and valve element 42 to seal opening 24. When lower edge 72 is below port 60, liquid can once again enter cylinder 58 in preparation for the next squeeze of the bottle.

Figure 8:
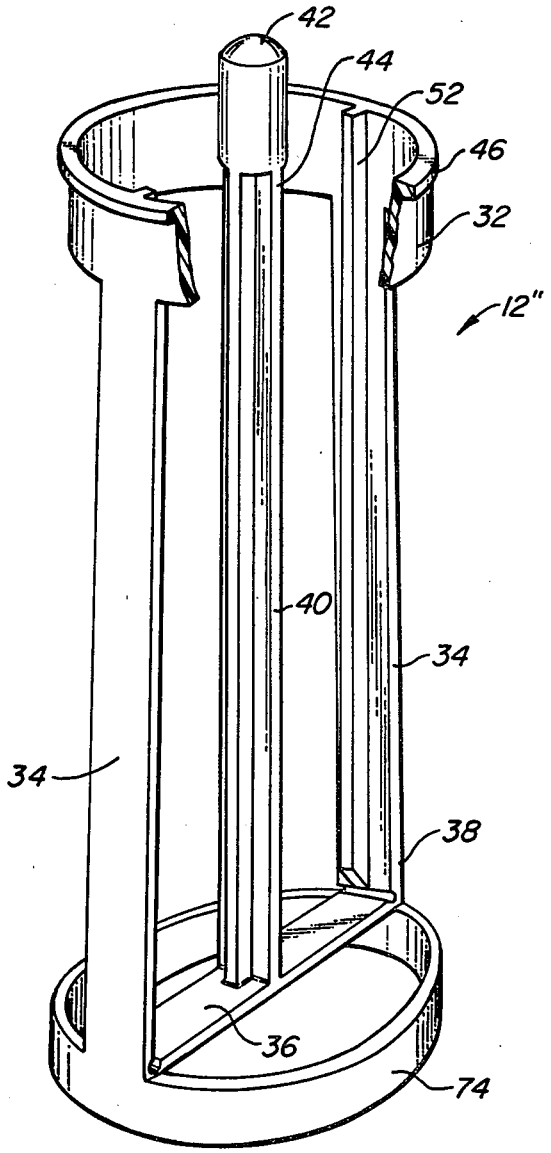
FIG. 8 is an isometric view of a second alternative embodiment of the valve assembly of FIG. 1.

Referring now to FIG. 8, a second alternative embodiment of valve assembly 12″ is disclosed. The primary distinction between assembly 12″ and assembly 12 is the addition of a resilient ring 76 attached to lower ends 38 of arms 34. Ring 74 acts, in conjunction with valve spring 36, to bias valve element 42 against valve seat 22. This occurs because when assembly 12″ is relaxed, spring 36 is flat and ring 74 is round. When cap 10 and valve assembly 12″ are mounted to mouth 6, spring 36 is deflected downwardly, as in FIG. 1, forcing ends 38 towards one another to deflect ring 74 into a slightly oval configuration. When in the operational mode squeezing bottle 4 to open outlet 24 will further deflect spring 36 and ring 74. However, when in the non-operational mode, squeezing bottle 4 along minimum width 50 will deflect ring 74. However, this deflection tends to separate ends 38 and straighten spring 36 thus increasing the sealing force between element 42 and seat 22. The increased sealing force is helpful under such circumstances to counteract the tendency of the liquid contents to be forced between element 42 and seat 22 when the container is inadvertently squeezed.

Other modifications and variations can be made to the disclosed embodiments without departing from the subject of the invention as defined in the following claims. For example, container closure 8 may be made as a single unitary piece rather than from two or more separate elements. The preferred shape of squeeze bottle 4 will generally be oval. However, containers having different other-than-round cross-sectional shapes, such as rectangular with sides of unequal lengths, can also be used. A three sided container using three actuating arms and rotatable over 60° from an operable to a non-operable condition may be used as well.

We claim:

1. A self-sealing liquid container assembly comprising:

a squeezable container having an other-than-round cross-sectional shape and a circular mouth, said container having minimum and maximum widths;

a cap mounted for rotary movement to said mouth, said cap having a valve seat defining an outlet opening;

a valve assembly means for sealing said outlet opening comprising:

a valve element configured for sealable engagement with said valve seat;

an elongate valve stem having a first end attached to said valve element and a second end;

a valve spring mounted to the second end of said valve stem; and means, coupled to spaced-apart points on said spring, for deflecting said spring to bias said valve element against said valve seat, said deflecting means including a pair of elongate arms positioned on each side of the stem and configured to further deflect said spring to withdraw said valve element from said valve seat when at least one said arm is deflected toward said valve stem;

means for coupling said cap and said deflecting means so rotary movement of said cap causes like rotary movement of said deflecting means, whereby when said container is squeezed along said minimum which said arm portion is deflected to open said outlet opening when said arm portion is aligned with said minimum width but not when aligned with said maximum width; and a resilient circumferential member mounted to said arms, said resilient member configured so when said container is squeezed along said second dimension said resilient member is deflected to urge said valve element toward said valve seat when said arm portion is aligned with said first dimension but not when aligned with said second dimension.

2. The container assembly of claim 1 wherein said circumferential resilient member is a ring mounted to said arms adjacent said spaced-apart points on said spring.

3. A self-sealing liquid container assembly comprising:

a squeezable container having an other-than-round cross-sectional shape and a circular mouth, said container having minimum and maximum widths;

a cap mounted for rotary movement to said mouth, said cap having a valve seat defining an outlet opening;

a valve assembly means for sealing said outlet opening comprising:

a valve element configured for sealable engagement with said valve seat;

an elongate valve stem having a first end attached to said valve element and a second end;

an elongate valve spring mounted to the second end of said valve stem at a central portion of said spring; and means, coupled to the ends of said spring, for deflecting said spring to bias said valve element against said valve seat, said deflecting means including a pair of elongate arms positioned on each side of the stem and configured to further deflect said spring to withdraw said valve element from said valve seat when at least one said arm is deflected toward said valve stem; and means for coupling said cap and said deflecting means so rotary movement of said cap causes like rotary movement of said deflecting means;

whereby when said container is squeezed along said minimum width said arm portion is deflected to open said outlet opening when said arm portion is aligned with said minimum width but not when aligned with said maximum width.

4. A self-sealing liquid container assembly comprising:

a squeezable container having first and second lateral dimensions and an outlet valve seat, said first dimension being substantially greater than said second dimension;

a valve assembly means housed within said container, said valve assembly means including a reciprocal valve element for sealing said outlet;

means for normally biasing said valve element against said outlet valve seat;

valve opening means actuatable upon squeezing pressure being applied to the container such that an inside surface of the container deflects a portion of said valve assembly in a direction collinear with said second lateral dimension of said container to cause said valve element to unseat and permit flow of contents from the container through said outlet; and means for reorienting said portion of said valve assembly internally of said container to render substantially inoperative said valve opening means upon squeezing pressure being applied to any part of the container.

5. An improved liquid container assembly of the type including a squeezable container having a self-sealing cap including a valve element biased by a spring to normally seal an outlet opening in the cap, the spring configured so that squeezing the container deflects the spring to withdraw the valve element from the valve seat to open the outlet opening, the improvement comprising:

a cylinder formed adjacent the outlet opening;

a piston sized for complementary sliding engagement within said cylinder;

means, coupled to said piston, for biasing said piston away from the outlet opening;

means for deflecting said biasing means when the container is squeezed to drive the piston towards the outlet opening thereby forcing a limited quantity of liquid through the outlet opening.

6. A self-sealing liquid container assembly comprising:

a squeezable container having first and second lateral dimensions and an outlet valve seat, said first dimension being substantially greater than said second dimension;

means, housed substantially within said container, for sealing said outlet valve seat comprising:

a valve element configured for sealable engagement with said valve seat;

a valve spring means for normally biasing said valve element against said valve seat, said valve spring means including an arm portion, said valve spring means configured to move said valve element off said valve seat when said arm portion is deflected by an inside surface of said container; and means for operably coupling said valve spring means and said valve element; and means for rotating said arm portion for alignment with said first and second lateral dimensions;

whereby when said container is squeezed along said second dimension said arm portion is deflected by said inside surface to open said outlet valve seat when said arm portion is aligned with said second dimension but not when aligned with said first dimension.

7. The liquid container of claim 6 wherein said first dimension is a maximum lateral dimension and said second dimension is a minimum lateral dimension.

8. The liquid container assembly of claim 6 wherein said container has an oval cross-sectional shape.

9. The liquid container assembly of claim 6 further comprising a cap including an outwardly flaired support rim having an outer edge extending past the remainder of the cap for supporting the container on said outer edge.

10. The liquid container assembly of claim 6 wherein said rotating means includes a cap rotatably mounted to a mouth of said container and means for attaching said sealing means to said cap.

11. The liquid container assembly of claim 6 wherein said operably coupling means includes an elongate valve stem.

12. The liquid container assembly of claim 11 wherein said valve spring means includes an elongate spring attached to said valve stem at a central portion of said spring and including one said arm portion extending from each end of said elongate spring.

13. The liquid container assembly of claim 6 further comprising means for dispensing a measured amount of liquid from said container including:

a cylinder formed adjacent said outlet valve seat;

a piston slidably mounted within said cylinder;

a piston spring means for normally biasing said piston away from said outlet valve seat, said piston spring means configured so when said arm portion is deflected by squeezing said container along said second dimension said piston spring means drives said piston towards said outlet valve seat; and means for operably connecting said piston and said piston spring means.

14. The liquid container assembly of claim 13 wherein said operably connecting means includes an elongate piston stem.

15. The liquid container assembly of claim 13 further comprising a port in said cylinder for passage of the liquid into the cylinder.

16. The liquid container assembly of claim 13 wherein said operably coupling means includes an elongate valve stem and said piston stem is tubular and surrounds a portion of said valve stem.

17. The liquid container assembly of claim 6 further comprising a resilient member mounted to said valve spring means, said resilient member configured so when said container is squeezed along said second dimension, said resilient member is deflected to urge said valve element toward said valve seat when said arm portion is aligned with said first dimension but not when aligned with said second dimension.

18. The liquid container assembly of claim 17 wherein said resilient member is a ring.

19. The liquid container assembly of claim 18 wherein said ring is circular.

20. The liquid container assembly of claim 18 wherein said ring is mounted to said arm portion.

* * * * *

UNITED STATES PATENT AND TRADEMARK OFFICE

CERTIFICATE OF CORRECTION

PATENT NO. : 4,457,453

DATED : July 3, 1984

INVENTOR(S) : Peter P. Stevens, Thomas R. McClure and Ann H. Firstenfeld

It is certified that error appears in the above-identified patent and that said Letters Patent is hereby corrected as shown below:

Col 5, Claim 1, line 22, delete "which" and substitute --width--.

Signed and Sealed this

Sixth Day of November 1984

[SEAL]

*Attest:*

GERALD J. MOSSINGHOFF

*Attesting Officer*

*Commissioner of Patents and Trademarks*